US005402744A

United States Patent [19]

Matamoros

[11] Patent Number: 5,402,744

[45] Date of Patent: Apr. 4, 1995

[54] MULTI-PURPOSE STORAGE BAG

[76] Inventor: Michael Matamoros, Rte. 1, Box 144, Oakley, Calif. 94561

[21] Appl. No.: 908,742

[22] Filed: Jul. 6, 1992

Related U.S. Application Data

[63] Continuation of Ser. No. 737,465, Jul. 30, 1991, abandoned.

[51] Int. Cl.[6] ..... B63B 35/00

[52] U.S. Cl. ..... 114/270; 114/361; 114/364

[58] Field of Search ..... 224/32 A, 42.11; 383/7, 383/38, 61, 59, 97; 114/270, 343, 361, 364

[56] References Cited

U.S. PATENT DOCUMENTS

| | | | |
|---|---|---|---|
| 2,813,602 | 11/1957 | MacArthur, Jr. | 224/42.11 X |
| 3,125,145 | 3/1964 | Williams | 383/38 X |
| 3,998,304 | 12/1976 | Edgerton, Jr. et al. | 383/61 X |
| 4,126,256 | 11/1978 | McGruder | 383/38 X |
| 4,258,869 | 3/1981 | Hilgendorff | 224/32 A |
| 4,442,960 | 4/1984 | Vetter | 224/32 A |
| 4,469,256 | 9/1984 | McEwen | 224/32 A X |
| 4,580,706 | 4/1986 | Jackson et al. | 224/32 A |
| 4,756,455 | 7/1988 | Kitner et al. | 224/42.11 |
| 4,909,176 | 3/1990 | Kobayashi | 114/343 |
| 4,955,516 | 9/1990 | Satterfield | 224/42.11 X |
| 5,076,191 | 12/1991 | Madore | 114/343 X |

FOREIGN PATENT DOCUMENTS

| | | | |
|---|---|---|---|
| 1086064 | 2/1955 | France | 224/32 A |

*Primary Examiner*—Allan N. Shoap
*Assistant Examiner*—Jes F. Pasna
*Attorney, Agent, or Firm*—Banner, Birch, McKie & Beckett

[57] ABSTRACT

A utility bag for use with a personal utility vehicle. The utility bag is formed of a pair of compartments which are used to hold the personal effects of the user. The two compartments are connected by a center portion which is adapted to fit over the personal utility vehicle.

3 Claims, 4 Drawing Sheets

MULTI-PURPOSE STORAGE BAG

This application is a continuation of application Ser. No. 07/737,465, filed Jul. 30, 1991, now abandoned.

BACKGROUND OF THE INVENTION

The present invention generally relates to the field of luggage cases and the like, and more particularly, is directed to a multi-purpose storage bag for use with personal utility vehicles such as water crafts, motorcycles, bicycles, all terrain vehicles and snow-mobiles.

Water sports have always been a popular form of leisure enjoyment for those having access to large bodies of water. One of the more popular water sports to emerge in the last several years involves the use of so-called personal water craft which are designed to be ridden by one person from a standing or kneeling position. One example of such a craft is is illustrated in FIGS. 1 and 2. The craft normally is driven by a gasoline engine which turns a suction pump. As shown in FIG. 3, the suction pump draws water through inlet 1 and expels it as a jet stream through outlet 2. The interaction of the jet stream with the water around the craft propels the craft forward.

As shown in 4, the craft typically includes an engine cover 3 which covers and protects the engine from water, an air intake 4 which provides fresh air to the engine, handle bars 5 for steering the craft and an exhaust outlet 6 for the engine exhaust. Also included are provisions for starting and stopping the engine. Many companies now manufacture personal water craft as heretofore described, including Kawasaki Motors Corp. which makes the well-known JET SKI.

Safe riding of personal water craft usually requires that both hands of the rider be on the handle bars at all times. Since the craft normally is not designed with storage compartments for the rider's use, any accessory items which the rider wishes to have must be carried on the rider's person. While relatively small items can be stored in pockets in the rider's clothing, large items must necessarily be carried in the rider's hands, or somehow be balanced by the rider on the craft. In either case, the rider is prevented from having complete and full control over the water craft. Thus, in order to free the rider's hands, means must be provided on the water craft for carrying items which can not be carried on the rider's person.

SUMMARY OF THE INVENTION

It is therefore, the overall object of the present invention to provide a water craft storage bag which allows the rider to carry a large number of accessory articles.

It is a specific object of the present invention to provide a water craft storage bag which can be mounted on the craft without affecting the performance of the craft.

It is another specific object of the present invention to provide a water craft storage bag which can be readily and easily mounted on a water craft.

It is a still further specific object of the present invention to provide a water craft storage bag which is low in cost and economical to manufacture.

It is another specific object of the present invention to provide a water craft storage bag which can be mounted on a large number of water craft of different designs and shapes.

DETAILED DESCRIPTION

Figure 1:
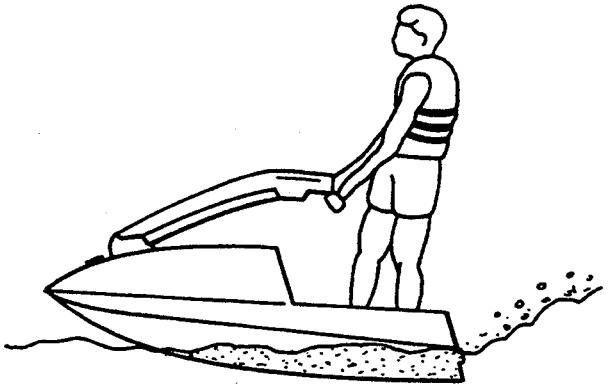
FIG. 1 is an elevational view illustrating one embodiment of a personal water craft being ridden in a standing position.
Figure 2:
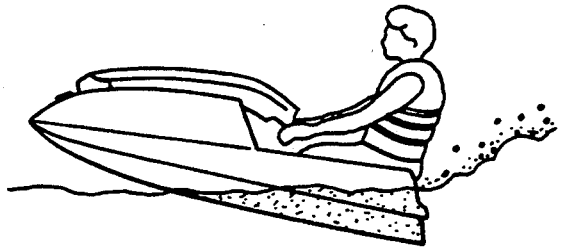
FIG. 2 is an elevational view illustrating the personal water craft shown in FIG. 1 being ridden in a kneeling position.
Figure 3:
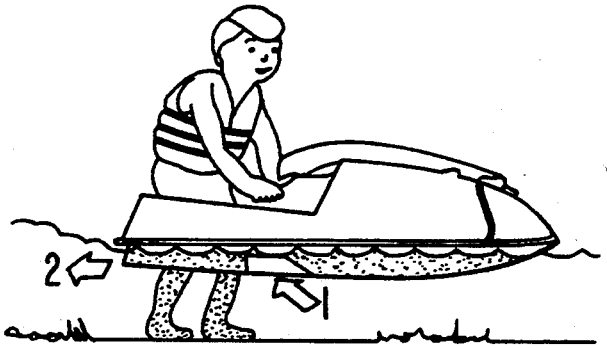
FIG. 3 is an elevational view illustrating the water inlet and outlet for the water craft shown in FIG. 1.
Figure 4:
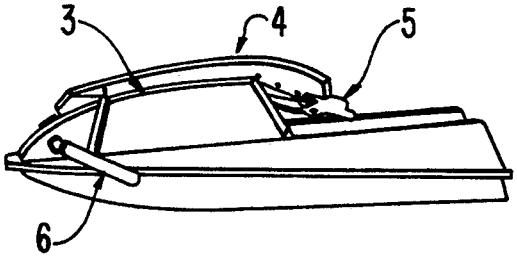
FIG. 4 is an elevational view illustrating the major components of the water craft shown in FIG. 1.
Figure 6:
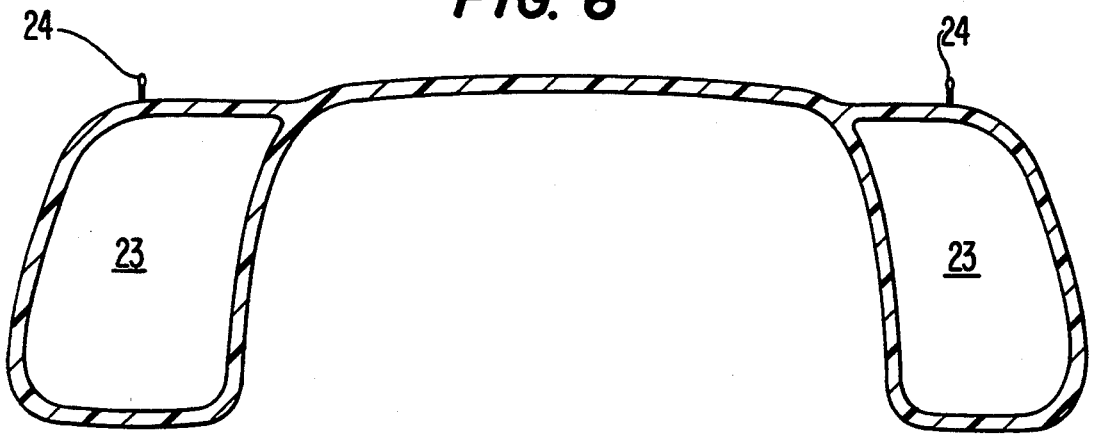
FIG. 6 is a cross-section taken along lines 6—6 in FIG. 5.
Figure 5:
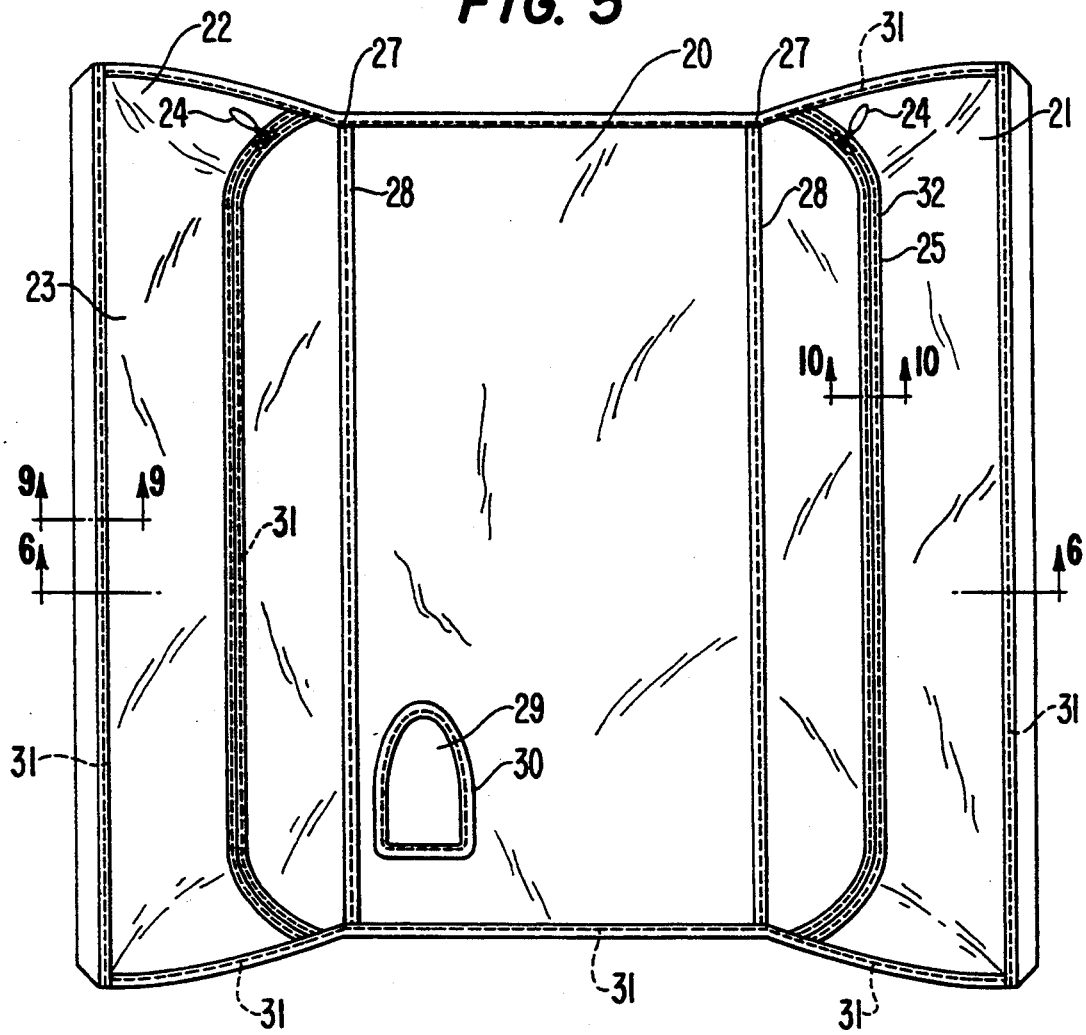
FIG. 5 is a bottom view of the storage bag of Applicant's invention.

With reference to FIG. 5, the multi-purpose bag of Applicant's invention is shown formed of a center portion 20 with attached slide flaps 21 and 22. Each side flap includes a storage compartment 23. The storage compartment is closed by zippers 24 along zipper line 25. As mentioned previously and as shown in FIG. 6, each storage compartment includes storage space 23 for carrying articles placed in the compartment by the user.

Each side flap is attached to center portion 20 at seam lines 27. The attachment can be made by needle stitching as indicated by dashed line 28 in FIG. 5.

Figure 7:
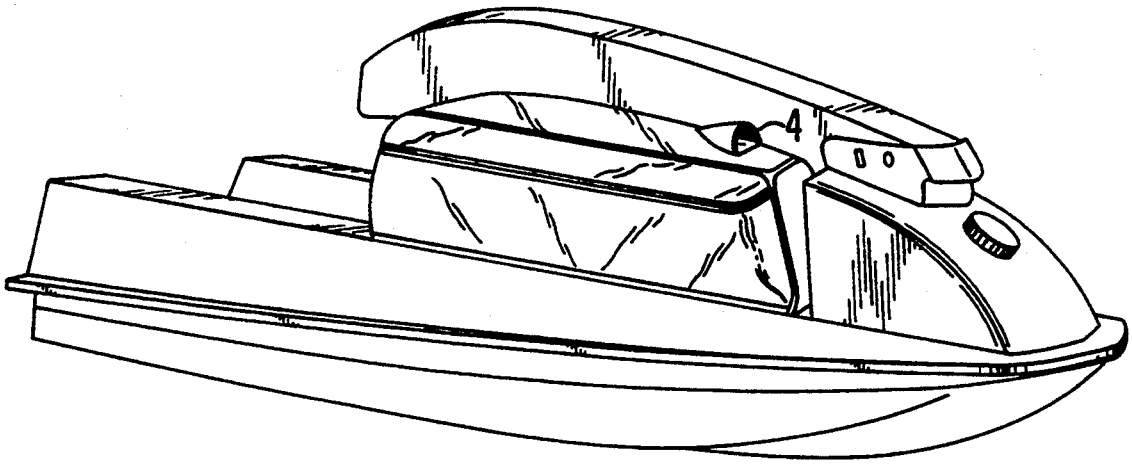
FIG. 7 is side perspective view of a water craft which includes the storage bag of Applicant's invention.
Figure 8:
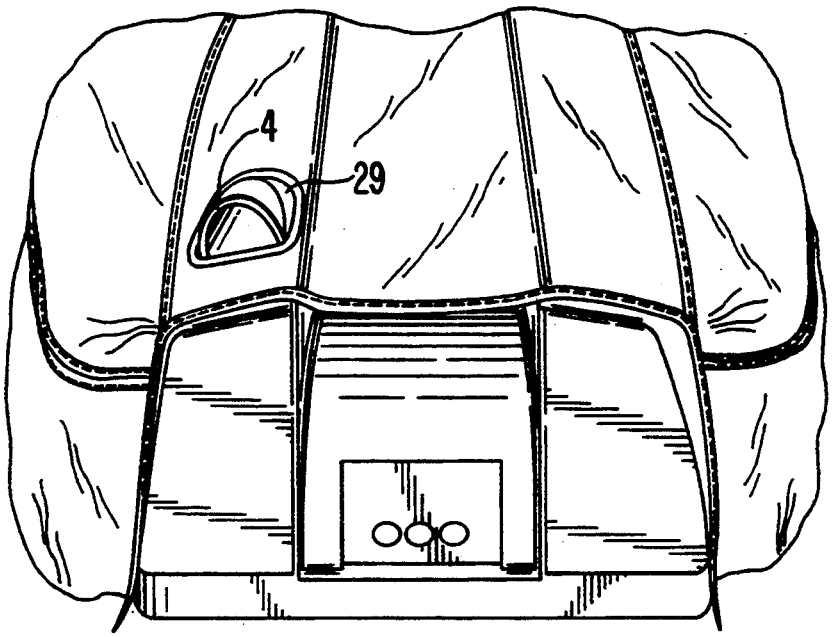
FIG. 8 is rear perspective view of the water craft shown in FIG. 5.

As shown in FIG. 5, center portion 20 also includes clearance hole 29. The purpose of hole 29 is to allow clearance for air intake 4 of the water craft engine as is illustrated in FIGS. 7 and 8. Hole 29 also includes reenforced edge 30 which prevents the inside edges of the hole from becoming frazzled.

Figure 10:
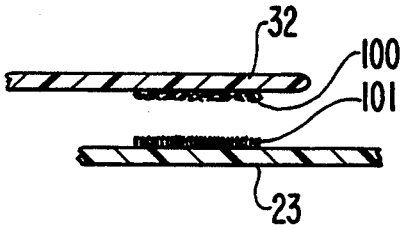
FIG. 10 is a cross-section taken along line 10—10 in FIG. 5.
Figure 9:
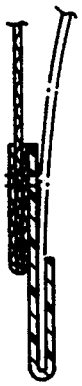
FIG. 9 is a cross-sectional view taken along lines 9—9 in FIG. 8.

The basic form of the bag can be made by one continuous piece of material with the end folded back over each other and stitched together, along stitch lines 31 to form each storage compartment 23 attached to center portion 20 at seam lines 27. See FIG. 9. Alternatively, each storage compartment may be formed of a separate piece of material and attached to center portion 20 at seam lines 27. After the bag is stitched together, each of the seam lines may be waterproofed with a sealing material as is well known in the prior art. The bag may also include a flap portion 32 as shown in FIG. 5 and FIG. 10 which covers zipper line 25. The flap portion includes a VELCRO brand hook and loop fastening strip 100 which mates and attaches to a companion VELCRO brand hook and loop fastening strip 101 attached to the exterior of compartment 23. The flap, thus, provides a measure of sealing for zipper line 25. The bag may be attached to a motor-craft as shown in FIG. 7 by suitable fasteners, such as eye-hole tie-downs, straps and buckles and bungie cord.

In accordance with the present invention, the bag may be made from various materials known in the prior art, include the following:

"Structural All" also known as "Vinyl Laminates" which is a vinyl coated polyester fabric (PVC coated vinyl with polyester weaving). The fabric is made with a high tenacity polyester and a special PVC resin. This material provides outstanding resistant, is dimensionally stable, and has high resistance against mildew, oil salt, sunlight and tearing.

"Pac-cloth" Nylon may also be used. This material is a water resistant fabric which is also used to make backpacks and jet ski covers). Marine vinyls which have a high resistance against mildew, oil, sunlight and Neoprene which is used for wet suits, scuba gear gloves and various accessories may also be used for Applicant's invention. In the case where a rubber material is used, seam lines 27 may be formed by pressing at high temperature as is well known in the prior art.

Numerous characteristics and advantages of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention as illustrated by annexed claims.

It is claimed:

1. In combination:

(a) a personal utility watercraft vehicle having an upper cover for covering an engine of the vehicle; and (b) a utility bag upon said personal utility watercraft vehicle, said utility bag comprising:

a planar and substantially rectangular center portion having opposite first and second sides, opposite forward and rearward sides, and upper and lower planar sides;

said planar center portion resting upon said upper cover of said vehicle;

said upper cover of said vehicle having a top surface which is substantially flat and without curvature in the direction from the rear to the front of the vehicle; and the entire said planar center portion being substantially flat and without curvature in the direction from the rear to the front of the vehicle in conformance with said top surface;

said forward and rearward sides of said center portion being substantially free from attachment;

a first elongated compartment for storing personal effects of a user connected along said first side of said center portion;

a second elongated compartment for storing personal effects of the user connected along said second side of said center portion;

said first and second compartments and said center portion being positioned in a generally inverted 'U' shape position as seen from the rearward side with said first compartment extending downwardly along a first side of said upper cover substantially below the entire center portion and said second compartment extending downwardly along a second side of said upper cover substantially below the entire center portion;

said first and second compartments each having a lowermost bottom wall which is substantially above water level during use;

said compartments being attached to said center portion only along said first and second sides of said center portion and each said first and second sides of said center portion delineating a respective substantially linear line;

said first and second compartments being pivotable about said first and second sides of said center portion, respectively, adapting said utility bag to said vehicle;

said compartments each comprising an opening proximate an upper end of the compartments;

sealing means for sealing said openings, wherein said sealing means comprises means for gradually and incrementally increasing the size of said openings such that the openings can be maintained partly and fully opened, said means for gradually opening including a flap portion, a hook and loop fastening strip attached to said flap portion and a companion hook and loop fastening strip attached to the exterior of said compartments;

said compartments each having an upper wall which extends generally horizontally outward from said center portion, each said openings extending substantially around sides of said compartment upper walls, said upper wall being moved when said sealing means is opened so as to provide access to said compartment, said compartment upper wall being the only compartment wall which extends over the upper side of the compartments such that only a single compartment wall is moved to provide access into each compartment and the utility bag is free from any overlying subcompartments;

said utility bag comprising a water resistant fabric material which is sufficiently water resistant to prevent substantial ingress of water when said utility bag is immersed in water; and said utility bag being fixedly attached to said upper cover and maintained upon said vehicle.

2. The utility bag of claim 1 wherein said utility bag comprises a continuous piece of material having ends which are folded back and attached to form said compartments and said center portion.

3. The utility bag of claim 1 wherein said center portion is a single piece substantially rectangular member; and wherein said center portion is connected to said compartments along substantially the entire lengths of said compartments.

* * * * *